US005517912A

United States Patent [19]

Winter

[11] Patent Number: 5,517,912

[45] Date of Patent: May 21, 1996

[54] PRINT SCREEN ALIGNMENT SYSTEM

[76] Inventor: Robert B. Winter, 2354 Redtail Dr., Neenah, Wis. 54956

[21] Appl. No.: 254,380

[22] Filed: Jun. 6, 1994

[51] Int. Cl.[6] ..... B41F 15/00

[52] U.S. Cl. ..... 101/114; 101/129; 101/415.1; 33/614

[58] Field of Search ..... 101/114–129, 415.1; 33/614, 617, 619, 621, 623

[56] References Cited

U.S. PATENT DOCUMENTS

| | | | |
|---|---|---|---|
| 3,098,431 | 7/1963 | Weaver . | |
| 3,943,851 | 3/1976 | Inada et al. . | |
| 4,440,080 | 4/1984 | Lyall . | |
| 4,603,641 | 8/1986 | Jeschke et al. | 101/415.1 |
| 4,911,070 | 3/1990 | Miske et al. . | |
| 4,974,508 | 12/1990 | Anderson et al. . | |
| 5,020,430 | 6/1991 | Harpold et al. . | |
| 5,063,842 | 11/1991 | Clarke . | |
| 5,094,160 | 3/1992 | Jennings . | |
| 5,127,321 | 7/1992 | Proffer . | |
| 5,129,155 | 7/1992 | Hoffman et al. | 33/614 |
| 5,168,805 | 12/1992 | Kasanami et al. | 101/128.21 |
| 5,188,026 | 2/1993 | Fuqua et al. . | |
| 5,226,362 | 7/1993 | Iaccino et al. . | |
| 5,226,366 | 7/1993 | Schlife et al. . | |
| 5,241,187 | 8/1993 | Ikeda et al. . | |
| 5,320,041 | 6/1994 | Maejima et al. | 101/415.1 |

*Primary Examiner*—Christopher A. Bennett
*Attorney, Agent, or Firm*—Ryan, Maki, Mann & Hohenfeldt

[57] ABSTRACT

A system for registering printing screens used for printing in series on a substrate which includes a plurality of outwardly projecting electrical switches, with a pair of the switches being positioned to engage a first side of a screen frame and at least one switch being positioned to engage a second side of the screen frame. The first and second sides of the frame are orthogonal relative to each other and, a pair of lights are activated by engagement of the frame with the switches, both of the lights being activated by simultaneous engagement of each of the switches by a screen frame. Similar sets of switches are provided on a table that supports the screens during exposure to an image to be replicated during printing and on a device that temporarily replaces a printing platen for alignment of each screen in a multi screen printing device.

3 Claims, 5 Drawing Sheets

PRINT SCREEN ALIGNMENT SYSTEM

FIELD OF THE INVENTION

This invention relates to a system for accurate alignment of printing screens used successively to provided multi-colored prints on a substrate such as paper or fabric.

BACKGROUND OF THE INVENTION

Screen printing procedures utilize a series of screens each coated with an emulsion that is selectively exposed to present a pattern through which ink may flow for application to a substrate such as a fabric or paper. The screens are prepared by coating a photosensitive emulsion onto a screen mesh and subsequently drying the emulsion. An artwork pattern is applied to the screen which is then exposed to a light spectrum which causes curing and hardening of that portion of the emulsion that is exposed. Washing of the uncured emulsion from the area of the screen shielded by the pattern to be reproduced provides a printing stencil. A series of stencils providing different colors to the overall pattern are then successively positioned in the printing device over the substrate and used to apply appropriately colored ink to the appropriate portions of the substrate.

To ensure proper location of the successive screens over the substrate, a variety of registration devices have been proposed in the prior art. Many of these involve the use of complex and costly mechanical equipment (see, for example, U.S. Pat. No. 5,063,842, issued on Nov. 12, 1991, and U.S. Pat. No. 5,226,362, issued on Jul. 13, 1993). Another proposal has been to utilize automatically controlled positioning devices to register the screens with a light source (see U.S. Pat. No. 5,241,187, issued Aug. 31, 1993). Yet another method of registration has been to use a series of pegs and clamps to assure alignment (see, for example, U.S. Pat. No. 5,226,363, issued Jul. 13, 1993; U.S. Pat. No. 5,094,160, issued Mar. 10, 1992; and U.S. Pat. No. 5,127,321, issued Jul. 7, 1992.

While the foregoing systems have performed satisfactorily in their respective environments, a need has continued to exist for a simple, efficient and economical registration system that is suitable for printing shops and jobs without requiring a high initial investment as is required by the above-noted prior art.

SUMMARY OF THE INVENTION

It is a principal object of the invention to provide a screen alignment system which easily, inexpensively and precisely registers a series of screens relative to a substrate so that printing can be applied accurately with respect to the substrate. In accordance with an important aspect of the invention, a device is provided wherein switches are positioned on two sides of a screen in a location to accurately indicate the position of a series of screens relative to the substrate. In accordance with a related aspect, the switches are used to activate a signaling device, preferably in the form of lights that can be viewed by the operator indicating that the screens are in the correct position for printing.

In accordance with a further related aspect, a similar series of switches and lights is used in placement of positives on the screens for exposure to indicate that each of the screens will be exposed at a specific location relative to the other screens of the series.

Briefly, the invention provides a system for registering printing screens used for printing in series on a substrate which includes a plurality of electrical switches, with a pair of the switches being positioned to engage a first side of a screen frame and at least one switch being positioned to engage a second side of the screen frame. The first and second sides of the frame are orthogonal relative to each other and, a pair of lights are activated by engagement of the frame with the switches, both of the lights being activated by simultaneous engagement of each of the switches by a screen frame. Similar sets of switches are provided (a) on a table that supports the screens during placement for exposure of positives of an image to be replicated during printing and (b) on a device that temporarily replaces a printing platen for alignment of each screen in a multi screen printing device.

Further objects and advantages of the invention will become apparent from the following detailed description and accompanying drawings.

DETAILED DESCRIPTION OF A PREFERRED EMBODIMENT

Figure 1:
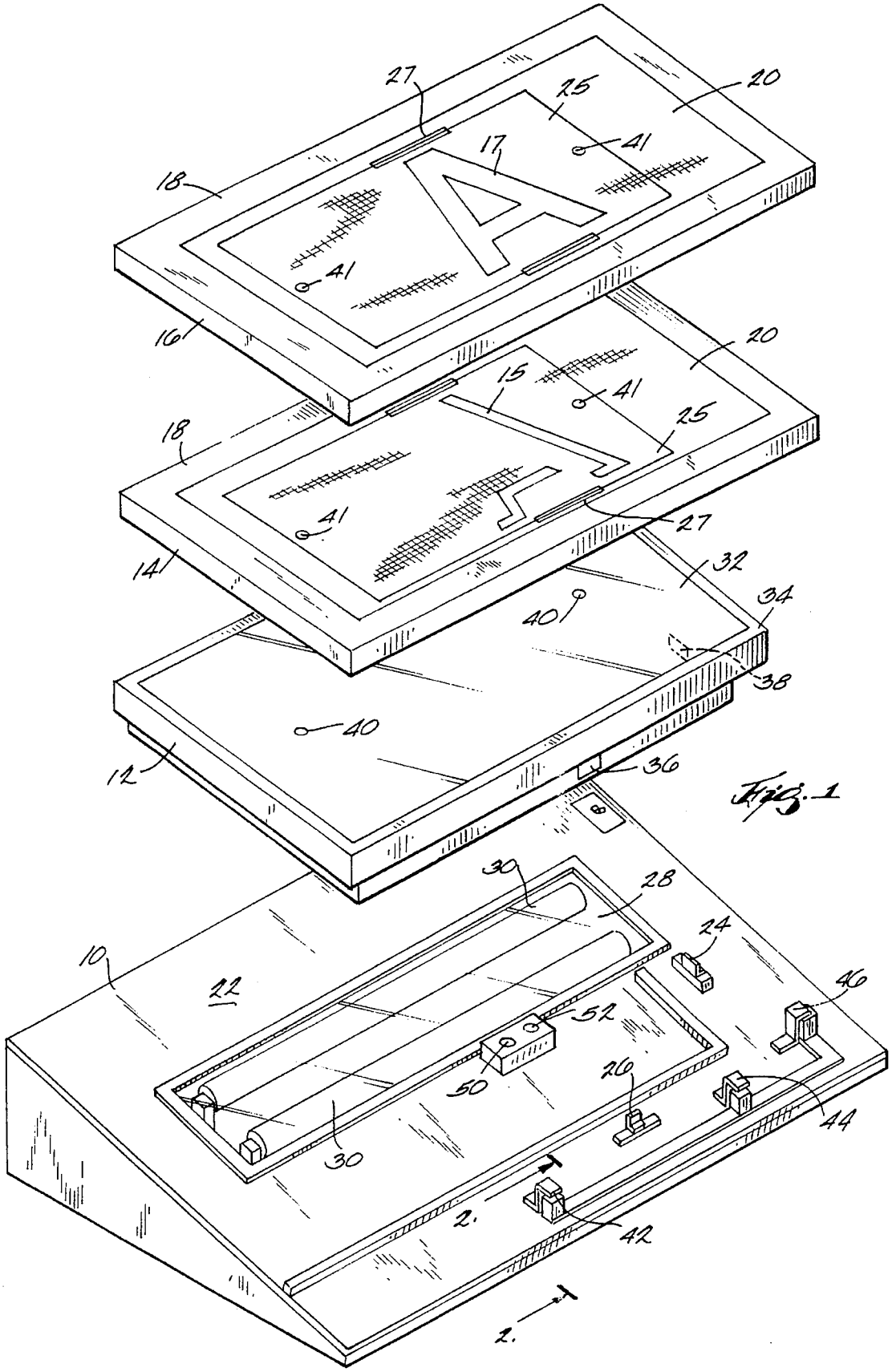
FIG. 1 is a perspective view with components separated illustrating the screen alignment device of the present invention and showing two screens to which positives are successively attached.
Figure 2:
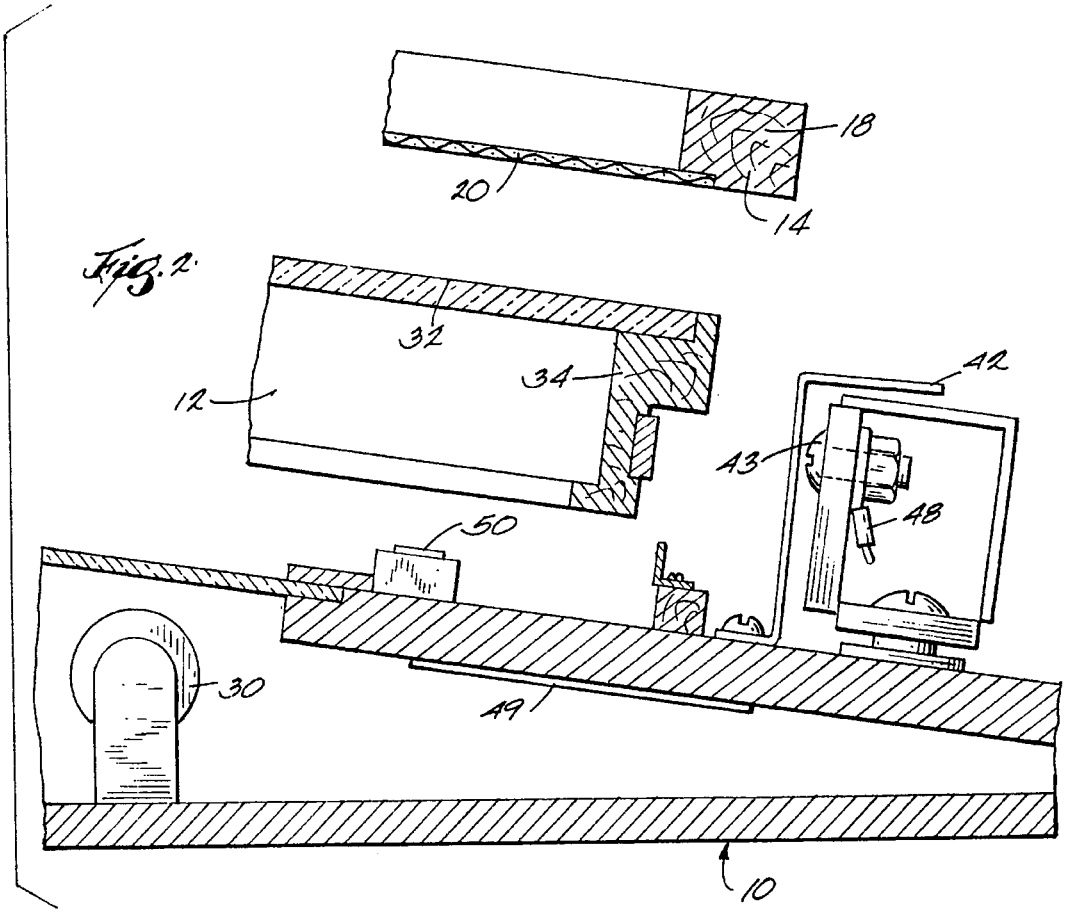
FIG. 2 is a fragmentary sectional view taken along line 2—2 of FIG. 1.
Figure 3:
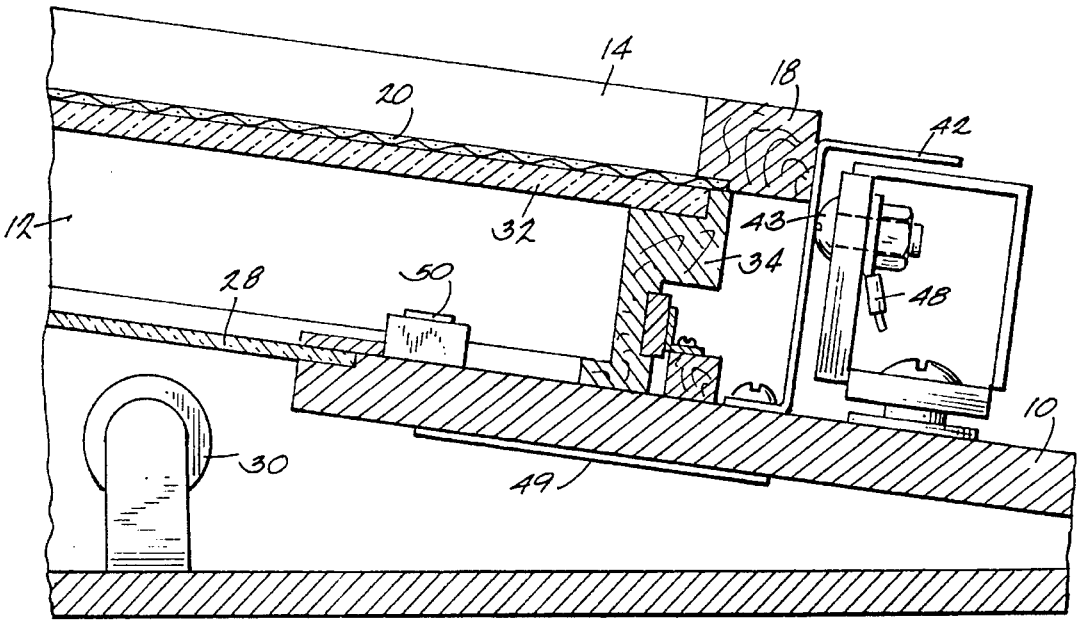
FIG. 3 is a fragmentary sectional view of the assembly shown in FIG. 2 with the parts in engagement.

Referring more particularly to the drawings, there is seen a base light table 10 and a registration grid overlay box 12 used for alignment of positive image containing prints on a series of screens 14 and 16 (two screens are shown for illustrative purposes, but in practice a larger number is usually employed). Each screen 14 and 16 includes a frame 18 and a screen 20 upon which sheets 25 of transparent material bearing positive images 15 and 17 are attached, for example, by tape 27. The sheets 25 bear alignment markings 41 for visual alignment with markings 40 on overly box 12. After alignment, the screens 20 are ready for exposure, development and washing of the emulsion coating on screens 20.

Base light table 10 includes a table surface 22 and magnetic alignment brackets 24 and 26. A plexiglass window 28 allows illumination of the screens by means of fluorescent lights 30.

Overlay box 12 is formed from a frame 34 which contains a glass or plexiglass top 32. Magnetic plates 36 and 38 are provided on the base of overlay box 12 for purposes of engagement with magnetic brackets 24 and 26. The overlay box 12 is, thus, accurately positioned on the base light table 10.

The top of overlay box 12 is provided with registration grid marks 40. These registration grid marks are spaced and sized so that they will align with corresponding grid marks on each positive of a multi-color printing job. The positives are placed in contact with the top of the screens 20 secured thereto by means of tape. After the film positives are, thus, precisely positioned and secured to the screen, each successive screen frame is taken to a device to expose the film positive on the screen. The film, after exposure, is removed and the screen is washed to remove the portion of the coating on screen 20 that was prevented by the film positive from being exposed. This process is repeated for each screen 14, 16 of the multi-color series of screens.

To ensure that each of the screens 14 and 16 is located at the same position relative to grid marks 40, a signaling device is provided on the base of the light table. This signaling device includes a pair of switches having contacts 42 and 44 on the lower side of the table and a switch having a contact 46 along one side thereof. The contacts 42 and 44 are normally biased out of contact with a bolt head 43 that serves as an electrical contact and is electrically connected by means of a lead 48 to a light 50 or 52. Contact bracket 42 is also connected to these lights by means of a lead 49. When a screen is correctly placed on the base table 10, each of the contacts 42, 44 and 46 will pivot into contact with its corresponding contact 43. These contacts close a pair of circuits so that lights 50 and 52 will both illuminate when the screen is in the correct position. Lights 50 and 52 are visible to an operator through the screens 20 and top 32. By successively positioning each screen 14, 16, etc., in a position where both of the lights 50 and 52 are illuminated, the successive screens will all be positioned correctly relative to the top 32 of the grid overlay box 12. This ensures proper alignment of images 15 and 17 relative to each other.

Figure 4:
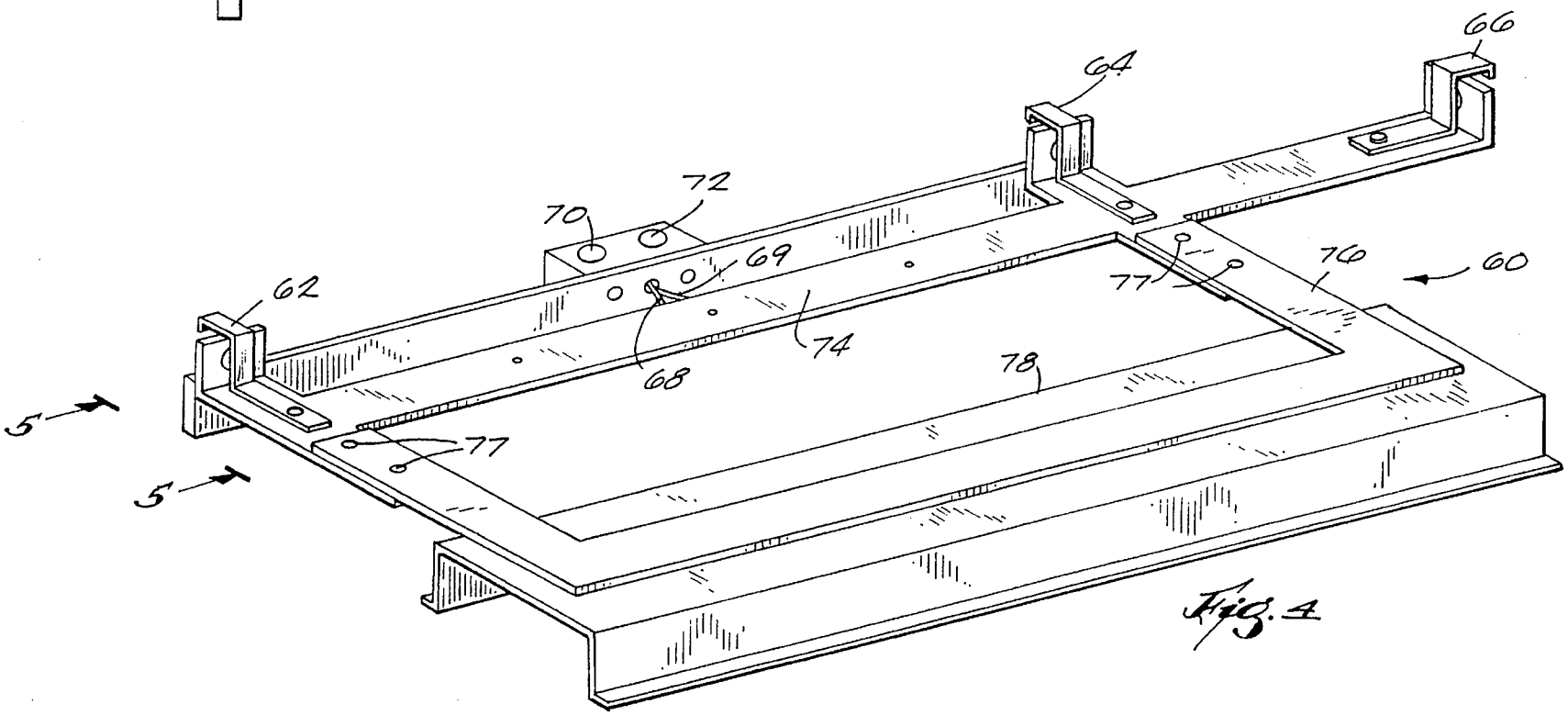
FIG. 4 is a perspective view of a printing station alignment assembly in accordance with the invention.
Figure 5:
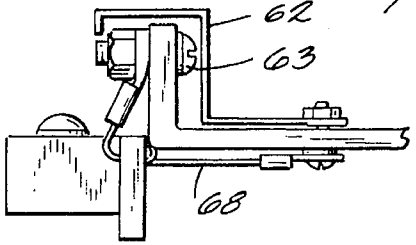
FIG. 5 is a fragmentary side view taken along Line 5—5 of FIG. 4.
Figure 7:
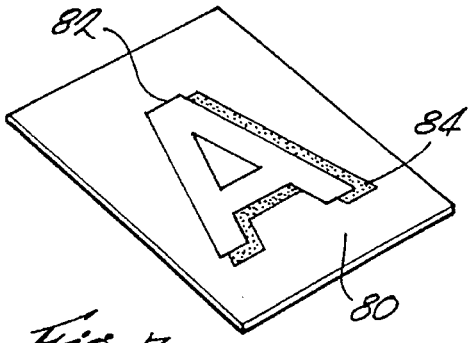
FIG. 7 is a perspective view of a substrate printed in accordance with the invention.

Referring to FIGS. 4 and 5, the aligning device 60 used to align a series of screens for a printing operation is illustrated. In use, device 60 is substituted for a printing platen in a multi screen printing device (not shown). Each screen is successively positioned on device 60 to correctly align it relative to the platen mount, and thus relative to each of the other screens of a series, and then clamped in place in the printing press.

Figure 6:
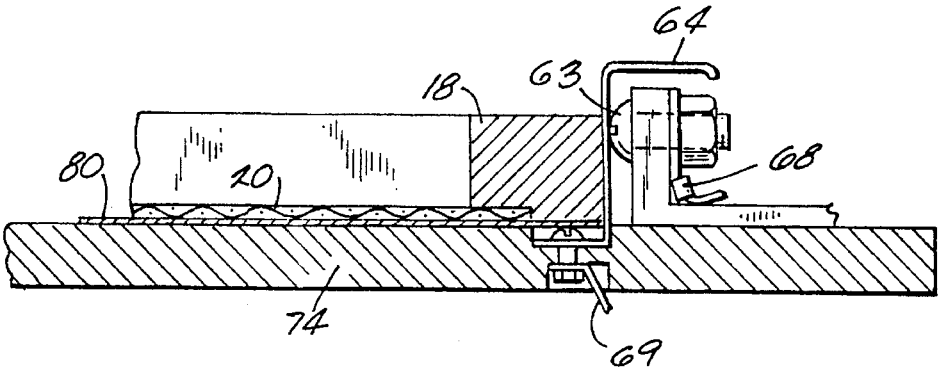
FIG. 6 is a fragmentary side sectional view showing a screen closing a switch.

Device 60 is provided with a series of electrical contacts 62, 64 and 66 positioned, relative to each of the screens 14 and 16, similarly to earlier described switch brackets 42, 44 and 46. Due to the fact that the screens are turned over for printing, the arrangement of switches 62, 64, 66 is in the orientation of a mirror image of the arrangement of switches 42. 44 & 46. Each of these switches is biased out of contact with a contact bolt 63. When the screens 14 or 16, etc., are placed in the registration device 60, the switches are closed as seen in FIG. 6. The bolt 63 and switches 62, 64 and 66 are connected by appropriate leads 68 and 69 to a pair of lights 70 and 72. When all three switch contacts 62, 64 and 66 are pivoted into contact with their respective contact bolts 63 by means of a screen such as 14 or 16, both of lights 70 and 72 are illuminated indicating correct registry of the screen with a platen 79 to which a substrate 80 is attached and on which printing is be performed. In accordance with known procedures, the screen 20 is then clamped in place on supporting mounts 85 of the printing apparatus 81, usually on one of a series of arms 86 that are rotatably supported to successively bring each screen 20 into contact with the substrate on which printing is performed. Printing apparatus of this general type is shown, for example, in U.S. Pat. No. 4,974,508 issued Dec. 4, 1990.

Alignment device 60 is formed from a metal such as aluminum, preferably from at least two parts, 74 and 76, connected by bolts or screws 77. By providing one of the components through which bolts 77 pass in the form of slots, adjustability as to the size (width) of alignment device 60 is achieved. An inverted extruded aluminum channel 78 is provided to support alignment device 60 on a typical press platen 79 mount with appropriate spacing, so that the screens 20 will be accurately located vertically as well as horizontally when the platen is replaced in the press 81 for printing. The need for channel 78, as well as its exact dimensions, will thus be dependent on the design of the specific printing apparatus being used.

Figure 8:
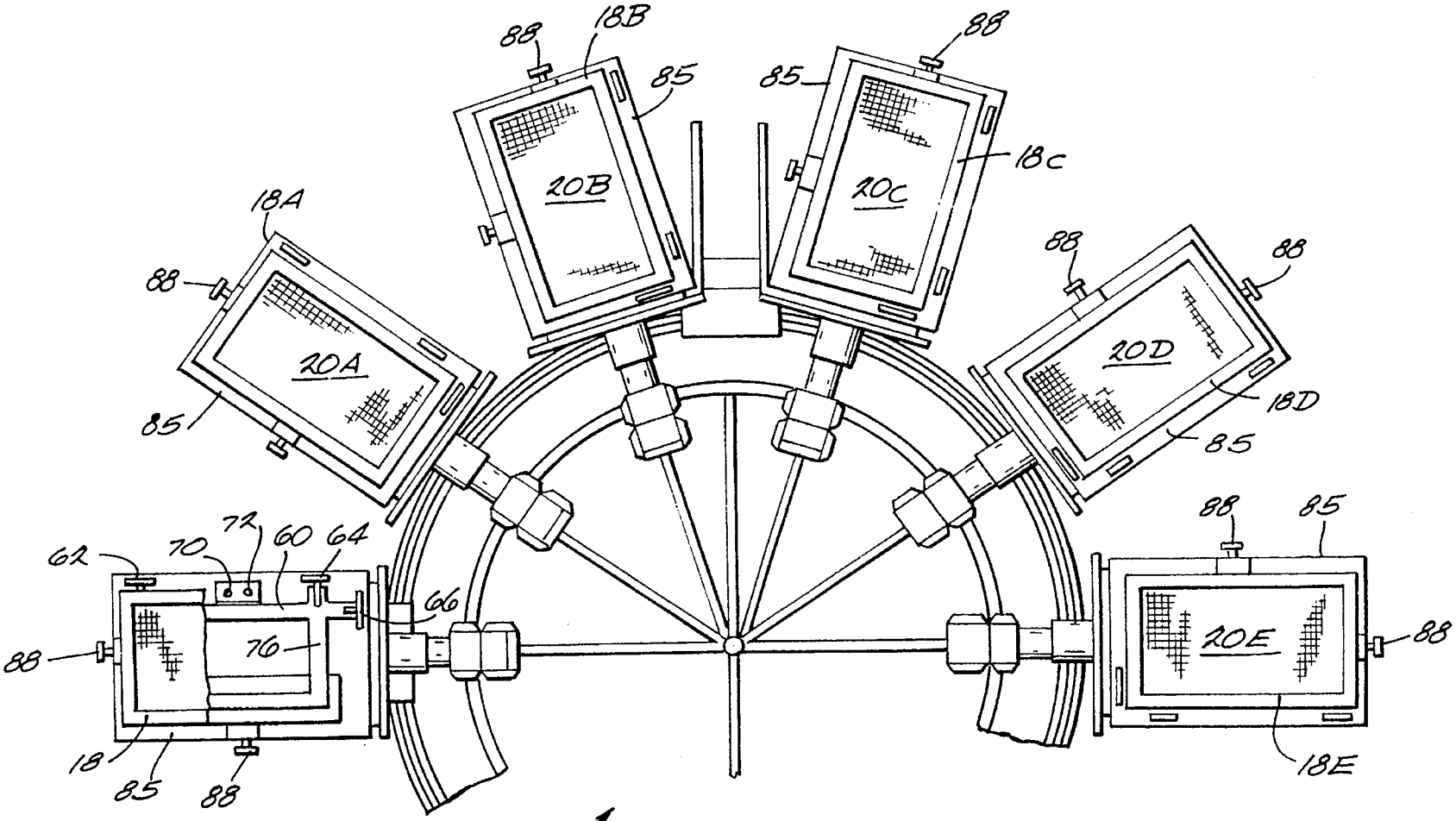
FIG. 8 is a partial top plan view showing a rotary screen printer in conjunction with the invention with parts broken away to show the interrelationship thereof.

As seen in FIG. 8, each screen 20A, 20B, 20C, 20D and 20E, etc., is attached to a mount 85 each carried on an arm 86. Clamps 88, of conventional design, secure the screens 20A–20E to the mounts. The clamps 88 can be loosened and subsequently tightened when the each successive screen is placed in alignment with alignment device 60. i.e., when the screen is aligned with device 60 so that both lights 70 and 72 are illuminated the screen 20 is tightened by means of clamps 88 to its respective mount 85. Each screen is thus aligned with each other screen of the series for use in a subsequent printing operation. Device 60 is subsequently removed and a platen for supporting the item printed on is inserted in the press 81.

A squeegee spreads an ink of a color corresponding to each component of the desired image into contact with substrate 80 through the opening in each successive screen 20. Thus, substrate 80 is provided with a composite image having printed images 82 and 84 corresponding to the parts of the desired original image.

While the foregoing preferred embodiment has been shown and described for purposes of illustration, it will be understood that there is no intent to thereby limit the invention, but rather, the invention is intended to cover all modifications and alternative constructions falling within the spirit and scope of the appended claims.

I claim:

1. A system for registering printing screens supported on a rectangular frame, and used for printing in series on a substrate comprising, in combination, a plurality of screens having an emulsion coating thereon, an overlay box comprising a back-lighted table, for successively supporting said screens in series, for exposure to light through a series of image-bearing sheets, said overlay box being provided with a light-transmitting surface provided with registration grid markings for accurate placement thereon of a series of image-bearing sheets, one of which corresponds to each successive screen, for exposure, each image bearing sheet having an image thereon in a selected color from a number of colors which together form a multi-colored composite image, a first screen registration device associated with said overlay box for accurate alignment of a series of positive images on a series of emulsion-coated screens for exposure, including, a first pair of switches positioned to engage a first side of a screen frame and at least one switch being positioned to engage a second side of said screen frame, said first and second sides of said frame being orthogonal relative to each other and, a pair of lights activated by engagement of a single frame with said switches, both of said lights being activated by simultaneous engagement of each of said switches by a screen frame, a second screen registration device for aligning said screens in correct alignment with each other for successive printing on a substrate using said screens in succession to form said multi-colored composite image on said substrate, said second screen registration device comprising a second set of outwardly projecting electrical switches, said second set of switches including a second pair of switches positioned to engage a first side of a screen frame and at least one switch of said second set of switches being positioned to engage a second side of said screen frame, said first and second sides of said frame being orthogonal relative to each other, and a second a pair of lights activated by engagement of a frame with said second set of switches, both of said lights being activated by simultaneous engagement of each of said second set of switches by a screen frame.

2. A system according to claim 1 wherein said second set of switches is arranged in a mirror image configuration relative to said first set of switches.

3. A system according to claim 1 wherein said second screen registration device is adapted to be fitted on printing apparatus in replacement of a removable platen which supports said substrate.

* * * * *